US009716308B2

(12) United States Patent
Mital et al.

(10) Patent No.: US 9,716,308 B2
(45) Date of Patent: Jul. 25, 2017

(54) WIDEBAND MULTI-FUNCTION PHASED ARRAY ANTENNA APERTURE

(75) Inventors: Rashmi Mital, Lorton, VA (US); Jaganmohan B Rao, College Park, MD (US); Dharmesh P. Patel, Fulton, MD (US); Gregory C Tavik, Rockville, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 542 days.

(21) Appl. No.: 13/617,088

(22) Filed: Sep. 14, 2012

(65) Prior Publication Data

US 2013/0207878 A1 Aug. 15, 2013

Related U.S. Application Data

(60) Provisional application No. 61/597,859, filed on Feb. 13, 2012.

(51) Int. Cl.
*H01Q 21/06* (2006.01)
*H01Q 1/34* (2006.01)
*H01Q 5/42* (2015.01)

(52) U.S. Cl.
CPC ..... *H01Q 1/34* (2013.01); *H01Q 5/42* (2015.01); *H01Q 21/061* (2013.01)

(58) Field of Classification Search
CPC ..... H01Q 1/34; H01Q 21/061; H01Q 5/0075
USPC ..... 343/853, 893, 909, 843, 770, 771
See application file for complete search history.

(56) References Cited

U.S. PATENT DOCUMENTS

| | | | | |
|---|---|---|---|---|
| 6,184,832 | B1 * | 2/2001 | Geyh | H01Q 21/0087 343/700 MS |
| 7,034,753 | B1 * | 4/2006 | Elsallal | H01Q 21/0006 343/700 MS |
| 7,764,236 | B2 * | 7/2010 | Hill | H01Q 1/243 343/702 |
| 8,405,564 | B2 | 3/2013 | Kindt et al. | |
| 9,472,843 | B2 * | 10/2016 | Takeuchi | H01Q 1/38 |
| 2010/0117917 | A1 * | 5/2010 | Kindt et al. | 343/843 |

OTHER PUBLICATIONS

B. Cantrell, J. Rao, G. Tavik, M. Dorsey and V. Krichevsky, "Wideband array antenna concept," IEEE Aerospace and Electronic Systems Magazine, vol. 21, No. 1, pp. 9-12 (2006).

(Continued)

*Primary Examiner* — Dameon E Levi
*Assistant Examiner* — Hasan Islam
(74) *Attorney, Agent, or Firm* — US Naval Research Laboratory; William P. Ladd

(57) ABSTRACT

A wideband multi-function phased array antenna aperture includes a plurality of low and high frequency phased array apertures that are asymmetrically dispersed over a largest aperture. Each aperture of the plurality of low and high frequency phased array apertures includes a plurality of frequency scaled radiating elements. The antenna aperture consolidates many functions into a single wideband multi-function phased array antenna where the use of frequency scaled elements reduces the total number of elements needed, thereby reducing the size, weight, power, cost and radar cross section when compared to conventional wide-band phased array architectures.

20 Claims, 9 Drawing Sheets

(56) References Cited

OTHER PUBLICATIONS

R. Kindt, M. Kragalott, M. Parent and G. Tavik, "Preliminary investigations of a low-cost ultrawideband array concept," IEEE Transactions on Antennas and Propagation, vol. 57, No. 12, pp. 3791-3799 (2009).

* cited by examiner

WIDEBAND MULTI-FUNCTION PHASED ARRAY ANTENNA APERTURE

CROSS-REFERENCE TO RELATED APPLICATIONS

This application claims the benefit of U.S. Provisional Application 61/597,859 filed on Feb. 13, 2012 and incorporated herein by reference.

FIELD OF THE INVENTION

The invention is directed to a phased array antenna, and in particular to a wideband multi-function phased array antenna aperture.

BACKGROUND OF THE INVENTION

Currently Navy ships employ a separate antenna for each function resulting in a proliferation of a large number of antennas on the ships to meet the numerous functional requirements. Recently, there is a significant interest to develop multi-function arrays using a single wideband antenna aperture, e.g. as described in G. Tavik, J. Alter, S. Brockett, M. Campbell, J. DeGraff, J. B. Evins, M. Kragalott, et al, "Advanced Multifunction Radio Concept (AMRFC) Program Final Report", NRL Memo Report, NRL/FR/5303—07-10,144 (June 2007). However, the number of radiating elements needed to avoid grating lobes, at the highest frequency of this wideband antenna aperture, becomes prohibitively large resulting in a complex and costly multi-function array. There is some effort to reduce the number of elements using frequency scaled arrays (see, e.g., B. Cantrell, J. Rao, G. Tavik, M. Dorsey and V. Krichevsky, "Wideband array antenna concept", *IEEE Aerospace and Electronic Systems Magazine*, vol. 21, no. 1, pp. 9-12 (2006) ("Cantrell et al."); R. Kindt, M. Kragalott, M. Parent and G. Tavik, "Preliminary investigations of a low-cost ultrawideband array concept", *IEEE Transactions on Antennas and Propagation*, vol. 57, no. 12, pp. 3791-3799 (2009) ("Kindt et al. 1"); and R. W. Kindt, M. Kragalott, M. G. Parent, and G. C. Tavik, "Wavelength-Scaled Ultra Wideband Antenna Array", PCT/US09/64154 (November 2009) ("Kindt et al. 2")), but such approaches are limited, e.g. the latter being limited to symmetric and/or square arrays. In one approach, the operating frequencies are chosen to be a factor of two apart, limiting the flexibility of the derived architectures.

Carrier class US Navy ships have the following satellite communication (SATCOM) link requirements. A link is needed to set up a direct path of communication between a shipboard antenna and a satellite. A carrier needs to have links for the following functions:

- TV-links at both C and Ku-bands
- Commercial links at C and Ku-bands
- Navy links at X and K-band, and
- Navy MetOc (Meteorological and Oceanographic) links at L and S-bands At least one link needs to be formed at each one of these frequencies. Table 1 lists the frequencies of interest as well as the antenna aperture size required to satisfy the directivity requirements. From Table 1 it can be seen that the C-band function needs the largest aperture size of 25.6 m2.

TABLE 1

SPECIFICATIONS OF SATCOM DOWNLINKS FOR A CARRIER

| System | Downlink Frequency (GHz) | Notional Directivity (dB) | Notional Aperture Size ($m^2$) | Maximum Inter-Element Spacing (mm) $d_x \times d_y$ |
|---|---|---|---|---|
| Commercial | 3.7-4.2 (C) | 47.0 | 25.6 | 35.7 × 35.7 |
| | 10.7-12.75 (Ku) | 49.0 | 5.2 | 11.8 × 11.8 |
| TV | 4.08-4.127 (C) | 41.0 | 5.3 | 36.3 × 36.3 |
| | 12.224 (Ku) | 43.0 | 1.0 | 12.3 × 12.3 |
| Navy | 20.2-21.2 (K) | 52.0 | 2.9 | 7.1 × 7.1 |
| | 7.25-7.75 (X) | 46.0 | 5.2 | 19.4 × 19.4 |
| MetOc | 1.684-1.71 (L) | 32.0 | 3.9 | 87.7 × 87.7 |
| | 2.205-2.2535 (S) | 34.0 | 3.6 | 66.6 × 66.6 |

For a rectangular lattice, e.g. as described in M. I. Skolnik, ed. "Radar Handbook", 2nd Ed., McGraw Hill, Boston Mich., pp. 7.17-7.25 (1990), the inter-element spacing for grating lobe free operation in both the x- and y-directions, can be calculated using Equation (1):

$$d_x = d_y = \frac{1}{2} \times \frac{c}{f_{highest}} \tag{1}$$

In Equation (1), c is the speed of light ($=3\times10^8$ m/s) and $f_{highest}$ is the highest frequency in the bandwidth of operation. The variables $d_x$ and $d_y$ represent the maximum inter-element spacing in the x- and y-directions respectively. Table 1 also lists the maximum inter-element spacing allowed for each function to ensure that the antenna pattern is grating lobe free over the entire bandwidth of operation. For example, to operate over the C-Band (3.7-4.2 GHz) the inter-element spacing can be at most 35.7 mm. A smaller inter-element spacing will also satisfy a grating lobe free operation, but a lot more elements will be needed to satisfy the directivity specification requirement.

If it is desired that a single aperture is designed to handle all the frequencies, then the radiating element used in the aperture will need to work from the lowest frequency of 1.684 GHz to the highest frequency of 21.2 GHz. Using the formula in Equation (1), the maximum inter-element spacing in this case will depend on the highest frequency, which is 21.2 GHz and will be equal to $d_x=d_y=7.1$ mm. This element will need to operate over a bandwidth of $$12.6{:}1\left(=\frac{21.2}{1.684}{:}1\right).$$

If an element of dimensions $7.1\times7.1$ ($mm^2$) were used to fill the largest array aperture of 25.6 $m^2$ required to satisfy the directivity at C-band, then almost 510,000 elements will be needed. This large number of elements will make this multi-function array very complex and costly.

In a conventional architecture as illustrated in FIG. 1, an element is channelized for each link that needs to be formed. In this example, eight links are needed, thus the output of each element will need to feed eight separate beamformers or in other words, the output of each element will feed eight phase shifters, eight attenuators etc. This extremely large number of components needed to form this multi-beam architecture further illustrates the complexity and high cost of a conventional multi-functional array.

Carrier Architectures

In an attempt to reduce the number of elements, the invention adopts the approach of using frequency scaled radiating elements which has also been adopted and discussed by Cantrell et al. and Kindt et al. 1-2. However, the method discussed by Cantrell et al could not be used here because of the constraint that requires equal beamwidth for all frequencies and arrays, which is not the case for the functions considered here. Strictly speaking, the method discussed by Kindt et al. 1-2 is too stringent for the desired application because it is designed to have equal beamwidth for functions at different frequency bands. However, the procedure of frequency scaling as used by Kindt et al. 1-2 can be modified for the problem at hand.

From Table 1, it can be observed that the inter-element spacing needed at K-band (20.2-21.2 GHz) is approximately ½ the size of the inter-element spacing needed at Ku-band (10.7-12.75 GHz). Similarly the inter-element spacing needed at Ku-band is about ⅓ the inter-element spacing needed at C-Band (3.7-4.2 GHz). The inter-element spacings needed at the other frequency bands lie somewhere in between the above two values. This means that an array with inter-element spacing designed for Ku-band can provide grating lobe free operation at all frequencies below 12.75 GHz. In similar vein, an array designed with inter-element spacing at C-band will provide grating lobe free operation at all frequencies below 4.2 GHz. Now, following the method discussed in Kindt et al. 1-2, symmetry is maintained in the array aperture. To maintain this symmetry the array with the smallest inter-element spacing (for the highest frequency) is either positioned at the center or at one corner of the multi-function phased array aperture. In the example shown in FIG. 2, the array with the smallest inter-element spacing (also referred to as the core) is positioned in the bottom right corner of the Multi-Function array (in this case, the C-band array). Next, the array designed to have the next larger inter-element spacing forms a layer around the perimeter of the core. Finally the outer-most layer will have the largest inter-element spacing.

FIG. 2 shows the inter-element spacings used for different sections of the Multi-Function phased array aperture. The core will have elements with the smallest inter-element spacing (i.e. x×x) where from Table 1, $$x = \frac{11.8\text{ mm}}{2} = 5.9\text{ mm}$$

followed by the second perimeter having inter-element spacing of 2x×2x. Finally the outer-most region will have inter-element spacing of 6x×6x. The value of 5.9 mm is chosen over the maximum allowed inter-element spacing of 7.1 mm for K-band because we want to keep whole number multiples between the inter-element spacings of the different regions as suggested by the designs in Kindt et al. 1-2. If the core has an inter-element spacing of 7.1 mm, then with a multiple of two, the inter-element spacing of the next outer layer will need to be 14.2 mm. This inter-element spacing will ensure no grating lobe formation for X-band and other lower frequency arrays. However, at Ku-band, this inter-element spacing is larger than the maximum allowed of 11.8 mm for grating lobe free operation and hence will result in the formation of grating lobes. By the same argument, using a whole number ratio of two between the inter-element spacing of the middle layer and the outer layer, the outer most layer will have an inter-element spacing of 2×2×7.1 mm=28.8 mm, which is smaller than the needed 35.7 mm. A smaller inter-element spacing will result in the need for more elements to satisfy the directivity requirement. To avoid this, an inter-element spacing of 11.8 mm of the middle layer is selected as the basis. This means, that now the inter-element spacing in the core will be half of 11.8 mm (i.e. 5.9 mm) while the inter-element spacing in the outer most layer will be three times 11.8 mm (i.e. 35.4 mm).

Since the core has the elements with the smallest inter-element spacing, reducing this spacing will result in a significant increase in the number of elements needed to satisfy the directivity requirement. To avoid this, fractional multipliers are applied between inter-element spacings of the different arrays. This will be discussed in more detail further below.

Note, that since the area required to satisfy the directivity for TV (Ku) function is smaller than the area of the K-band array, it is better to use only a portion of the K-band array. If the entire array were to be used, then more directivity than needed will be obtained, which is a bonus, but at the same time more phase shifters, attenuators and other components would also be needed. This will unnecessarily make the system more complex and costly. A similar reasoning can be used for the L and S-band arrays, which are smaller than the X/Ku/TV(C) band arrays.

By using the architecture where the inter-element spacings are frequency scaled, it is possible to reduce the number of elements significantly. Using frequency scaled architectures, as shown in FIG. 2; the total number of elements are reduced from 510,000 to only 116,110, which is almost a 77% decrease in the number of elements needed to form 8 beams. One of the difficulties in implementing this architecture is that the radiating elements in the core region need to have a bandwidth of 12.6, which is very difficult to achieve. Another issue is that the core of this architecture needs to be able to form eight links simultaneously. At present, there are no simple and cost effective beamforming techniques that are capable of forming eight simultaneous beams with very small element spacing (5.9 mm) needed for this design. The emergent simple and cost effective beamforming technology at present is only capable of providing a maximum of four simultaneous beams (see Kindt et al. 2). Still another point of concern is the fact that low frequency links such as the L and S-bands which are able to provide grating lobe free operation even at large inter-element spacings (87.7 mm and 66.6 mm respectively) are being forced to use much smaller elements and inter-element spacings. This significantly increases the number of elements needed at these frequencies and hence also increases the number of components needed, increasing the cost and complexity of the arrays. At the same time, there is a large area of the C-band array that has only one link on it while a small corner of the array is forced to provide eight links.

BRIEF SUMMARY OF THE INVENTION

According to the invention, a wideband multi-function phased array antenna aperture includes a plurality of low and high frequency phased array apertures that are asymmetrically dispersed over a largest aperture. Each aperture of the plurality of low and high frequency phased array apertures includes a plurality of frequency scaled radiating elements.

The invention overcomes prior art limitations, while still using frequency scaled elements, (i.e. the inter-element spacing of the radiating elements in the array are scaled as a function of frequency), to reduce the number of radiating elements, and hence the cost and complexity of the multifunction arrays. The invention also reduces the required number of beams (or links) from any given part of the aperture and minimizes the bandwidth requirement for both the radiating elements and the electronics behind them. A reduction in the number of beams from any part of the aperture will result in the use of realizable chipset beamformers (see, e.g., D-W Kang, K-J, Koh, and G. M. Rebeiz "A Ku-band Two Antenna Four Simultaneous Beams SiGe BiCMOS Phased Array Receiver", *IEEE Transactions on Microwave Theory and Techniques*, pp. 771-780, Vol. 58, NO. 4 (April 2010) ("Kang et al.")) as well as a decrease in the required bandwidth of the array elements.

The invention provides novel architectures that can consolidate many functions into a single wideband Multi-Function phased array antenna and reduce the total number of elements needed, thereby reducing the size, weight, power, cost and radar cross section when compared to conventional wideband phased array architectures. These novel architectures use frequency scaled elements to reduce the number of radiating elements; many radiating elements in the aperture are scaled as a function of frequency. These architectures also reduce the number of links needed from any part of the aperture and minimize the bandwidth requirement for both the radiating elements and the electronics behind them by properly dispersing the functions over a large aperture, thus further reducing the size, weight, power and cost requirements.

DETAILED DESCRIPTION OF THE INVENTION

Figure 1:
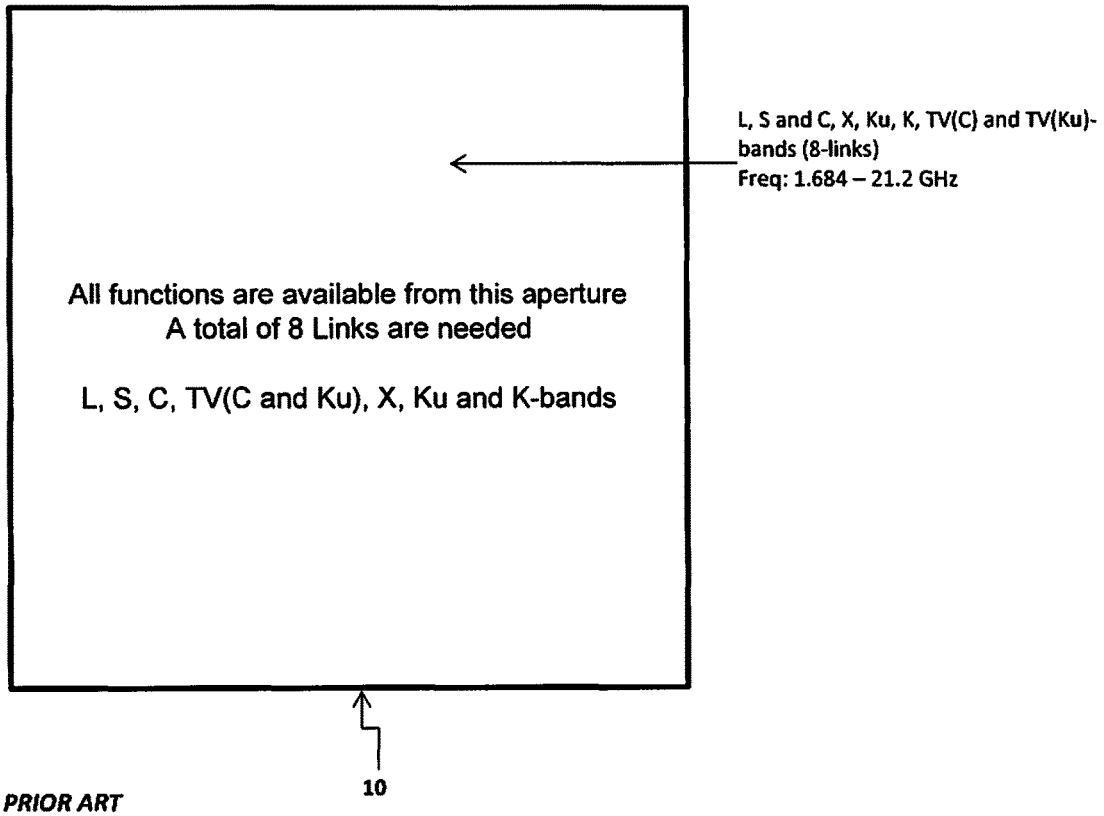
PRIOR ART FIGURE 1
FIG. 1 shows an architecture of a multi-function aperture using conventional methods.

Definitions: As used herein, C-Band frequencies are a set of radio frequencies ranging from 4 to 8 gigahertz (GHz); K-Band frequencies are a set of radio frequencies ranging from 18 to 27 GHz; Ku-Band frequencies are a set of radio frequencies ranging from 12 to 18 GHz; S-band frequencies are a set of radio frequencies ranging from 2 to 4 GHz; L-band frequencies are a set of radio frequencies ranging from 1 to 2 GHz; X-Band frequencies are a set of radio frequencies ranging from 8.0 to 12.0 GHz; TV(C)-band frequencies are a set of radio frequencies ranging from 4.0 to 4.2 GHz; and TV(Ku)-band frequency is 12.224 GHz.

Carrier Architectures

As discussed above and referring again to FIG. 2, a prior art architecture with the frequency scaled inter-element spacings, which reduces the number of elements, e.g. from 510,000 to only 116,110, but has the above-mentioned problems associated with that approach. As is discussed below, the invention overcomes these limitations, while still using frequency scaled elements to reduce the number of radiating elements. The invention also reduces the required number of beams (links) from any given part of the aperture and at the same time reduces the bandwidth requirement for the radiating elements by judiciously dispersing the smaller apertures over the larger aperture, as will be discussed next.

Figure 2:
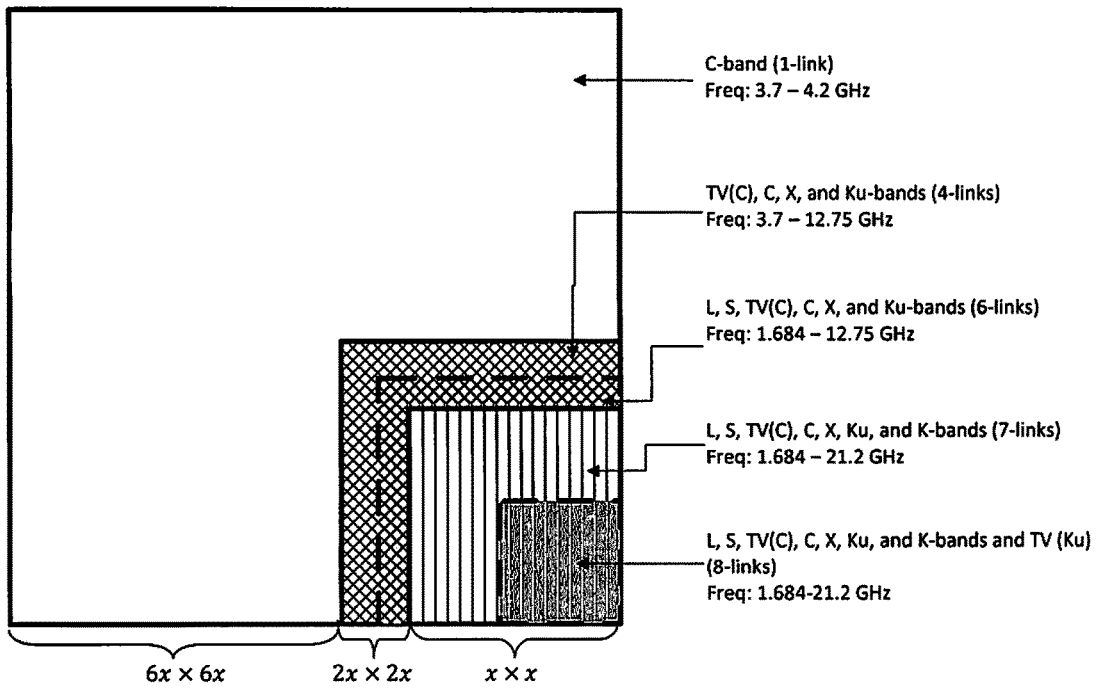
PRIOR ART FIGURE 2
FIG. 2 shows a prior art architecture of a Multi-Function Aperture using frequency scaling.
Figure 3:
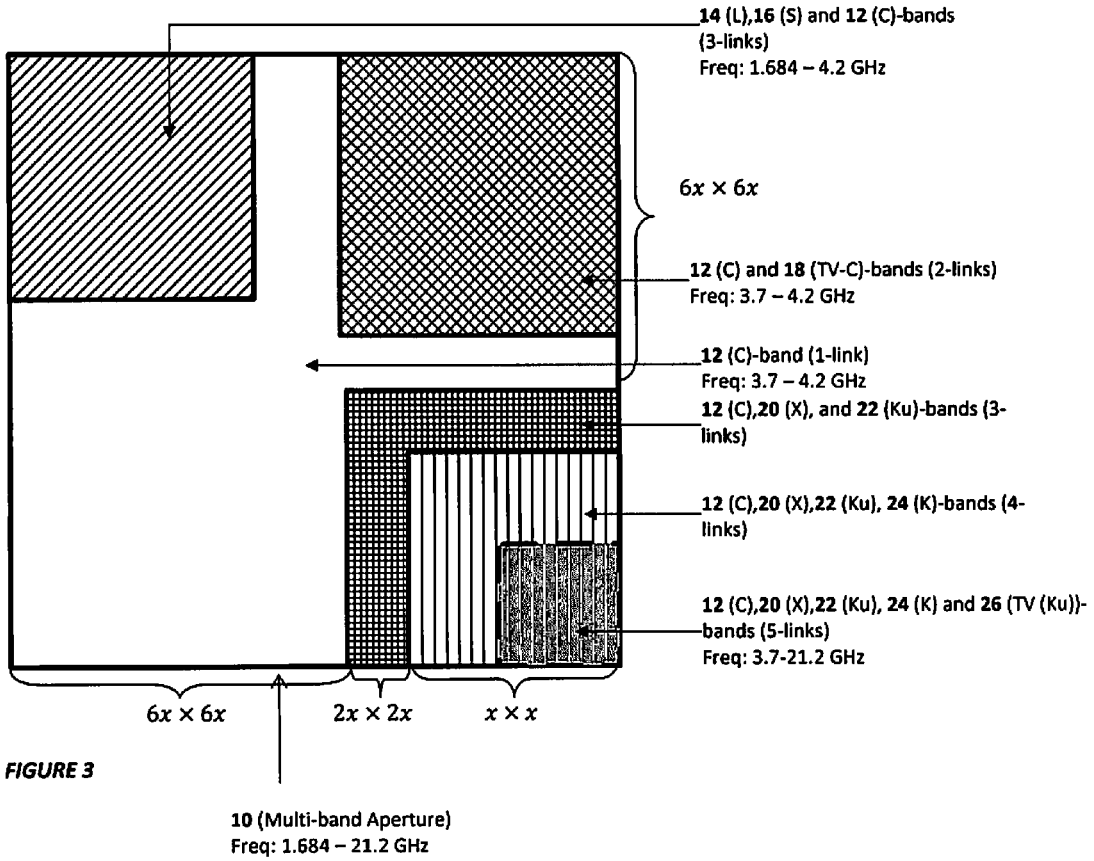
FIG. 3 shows an architecture of a Multi-Function Aperture (Architecture 1) for a Carrier according to the invention with square shaped individual arrays, x=5.9 mm.

Referring now to FIG. 3 (Carrier Architecture 1), a Multi-Function Phased Array Antenna Aperture 10 includes a C-band array aperture 12 with asymmetrically dispersed low and high frequency phased array apertures at L-band 14, S-band 16, TV(C)-band 18, X-band 20, Ku-band 22, K-band 24, and TV(Ku)-band 26. From Table 1, it is seen that for L-, S-bands, and TV(C)-bands, the inter-element spacing needed for grating-lobe free operation can be larger than the inter-element spacing needed for C-band. This means that the functions at these frequencies will be able to operate with grating lobe free operation using C-band inter-element spacing. Thus, by breaking up the symmetry of the C-band aperture and dispersing these low frequency phased array apertures at L-band 14, S-band 16, TV(C)-band 18 over the C-band aperture, it is possible to reduce the number of links needed from any section of the Multi-Function Phased Array Antenna Aperture. In this case, the higher frequency apertures at X-band 20, Ku-band 22, K-band 24, and TV(Ku)-band 26 are kept in the same location as in FIG. 2. Comparing FIG. 2 with FIG. 3, it is seen that now the maximum number of links needed from any section of the Multi-Function array is reduced from eight to only five. In addition, the largest bandwidth requirement (in terms of ratio of highest frequency to lowest frequency) for any section of the Multi-Function array is reduced to 5.7

$$\left(=\frac{21.2\text{ GHz}}{3.7\text{ GHz}}\right)\text{ from }12.6\left(=\frac{21.2\text{ GHz}}{1.684\text{ GHz}}\right)$$

for FIG. 2. Designing antenna elements to operate over a bandwidth ratio of 5.7 is feasible but obtaining bandwidth ratio of 12.6 is difficult, if not impossible. Since the frequency scaling of the elements is the same in the two architectures, no more elements than that in FIG. 2 are needed in FIG. 3.

Figure 4:
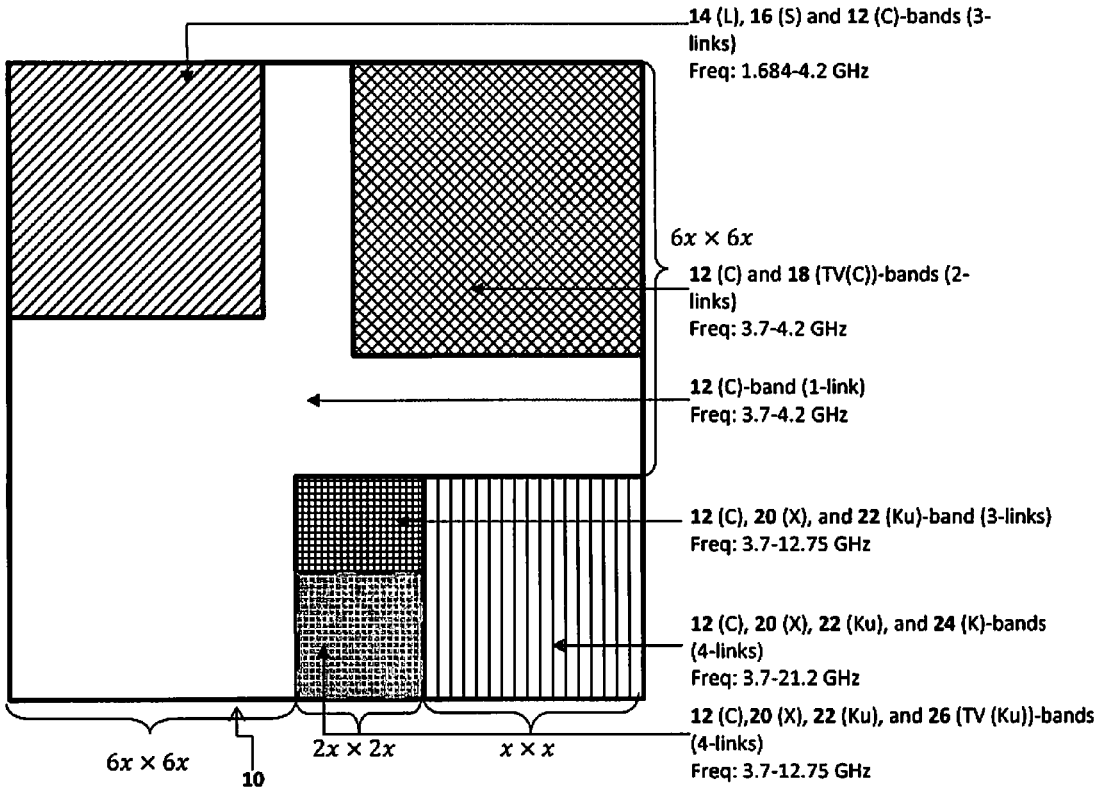
FIG. 4 shows an architecture of a Multi-Function Aperture (Architecture 2) for a Carrier according to the invention using both square and rectangular individual arrays, x=5.9 mm.

So far, in all the architectures that have been considered, the arrays have had square shapes. A square shaped array has equal beamwidth in both horizontal and vertical planes. For SATCOM applications, for which these arrays are being designed, there is no requirement for the two orthogonal beamwidths to be equal. Hence, the arrays can be rectangular in shape. In FIG. 4, the array used for the X- and Ku-bands is made longer in its width compared to its height. By making this alteration, the area with the inter-element spacing of 2x×2x no longer surrounds the area with inter-element spacing of x×x on top and side—it is only on the side (see FIG. 4). It turns out that with this change, the width of this 2x×2x new area is now as large as the width of the area needed by the TV(Ku)-band array to satisfy its directivity requirement. Also, the inter-element spacing of 2x is less than 12.3 mm needed by TV(Ku)-band array for grating-lobe free operation. So the 2x×2x area with the larger inter-element spacing can easily be used for the TV(Ku)-band array. By making this change, the maximum number of links needed from any section of the Multi-Function aperture is reduced from five to four. The presently available beamforming techniques can support generating four simultaneous beams (see Kang et al.). A further benefit is the fact that fewer components will now be necessary to form the beamformer for TV(Ku)-band array. In addition, the total number of elements needed for Carrier architecture 2 (FIG. 4) is the same as that for Carrier architecture 1 (FIG. 3).

Figure 5:
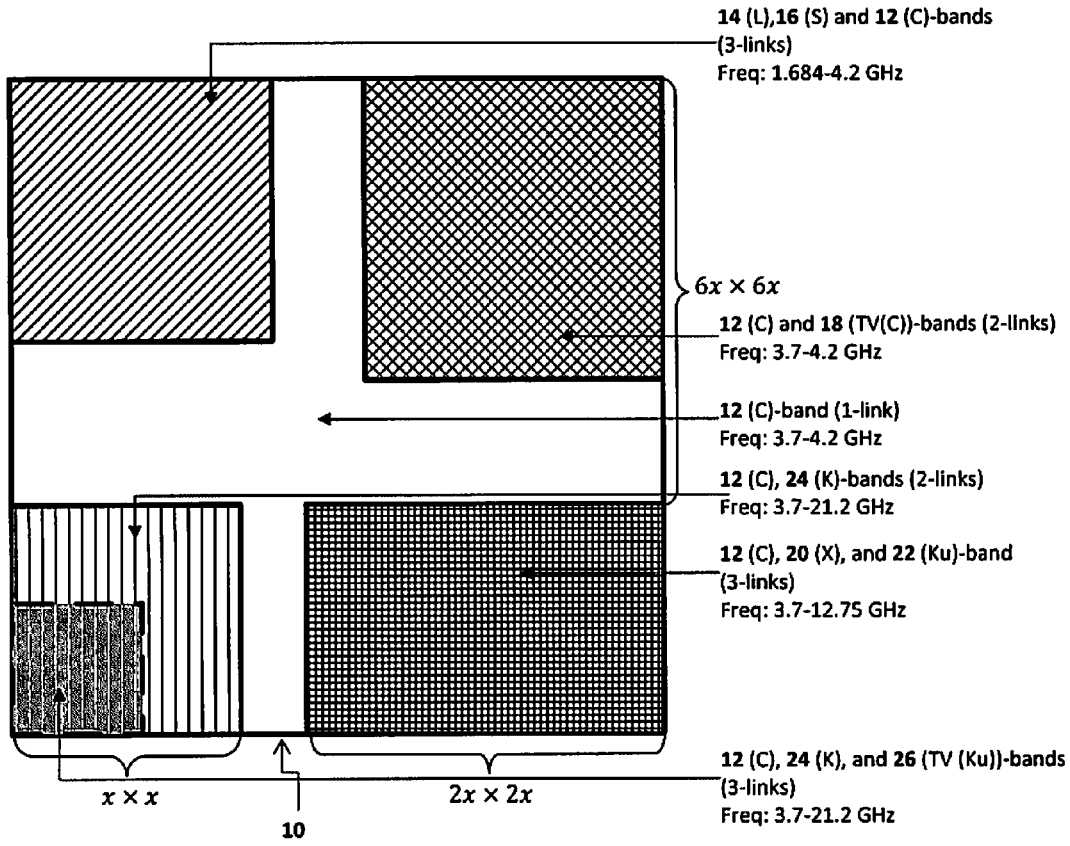
FIG. 5 shows an architecture of a Multi-Function Aperture (Architecture 3) for a Carrier according to the invention with re-arranged individual square arrays, x=5.9 mm.

Finally, it is observed that the bottom left corner of the C-band array in FIG. 4 provides only one link. By separating the K-band array as well as the TV(Ku)-band array from the X and Ku-band array, as shown in FIG. 5, it is possible to reduce the maximum number of beams (links) needed from any section of the Multi-Function aperture to only three. However, this architecture results in an increase in the total number of elements from 116,110 to 135,260 (about a 16% increase). So Carrier architecture 2 (FIG. 4) should be chosen if the smaller number of elements is important, and Carrier architecture 3 (FIG. 5) should be chosen if the smaller number of beams (links) from any section of the Multi-Function aperture is important.

So far, the invention has employed the constraint that the ratios of the inter-element spacings between the different individual arrays is always a whole number. By removing this constraint, it is possible to reduce the number of elements further. In fact, if one takes the architecture shown in FIG. 4 (Carrier Architecture 2) and changes the ratios to those shown in FIG. 6 (Carrier Architecture 4) whereby the inter-element spacing of the elements in the core (K-band array) is x×x with x equal to 7.1 mm, the inter-element spacing of the middle section (i.e. the array contributing to the X, Ku and TV(Ku)-band links) is 1.5x×1.5x and finally, the inter-element spacing in the remainder of the Multi-Function Array is 4.5x×4.5x. With these design changes, the total number of elements is reduced from 116,110 to 97,810, which is almost a 16% reduction in the total number of elements. This reduction in total number of elements comes from the fact that the inter-element spacing for K-band array (x) is increased from 5.9 mm used in the architecture of FIGS. 4 to 7.1 mm used for the architecture shown in FIG. 6.

Figure 6:
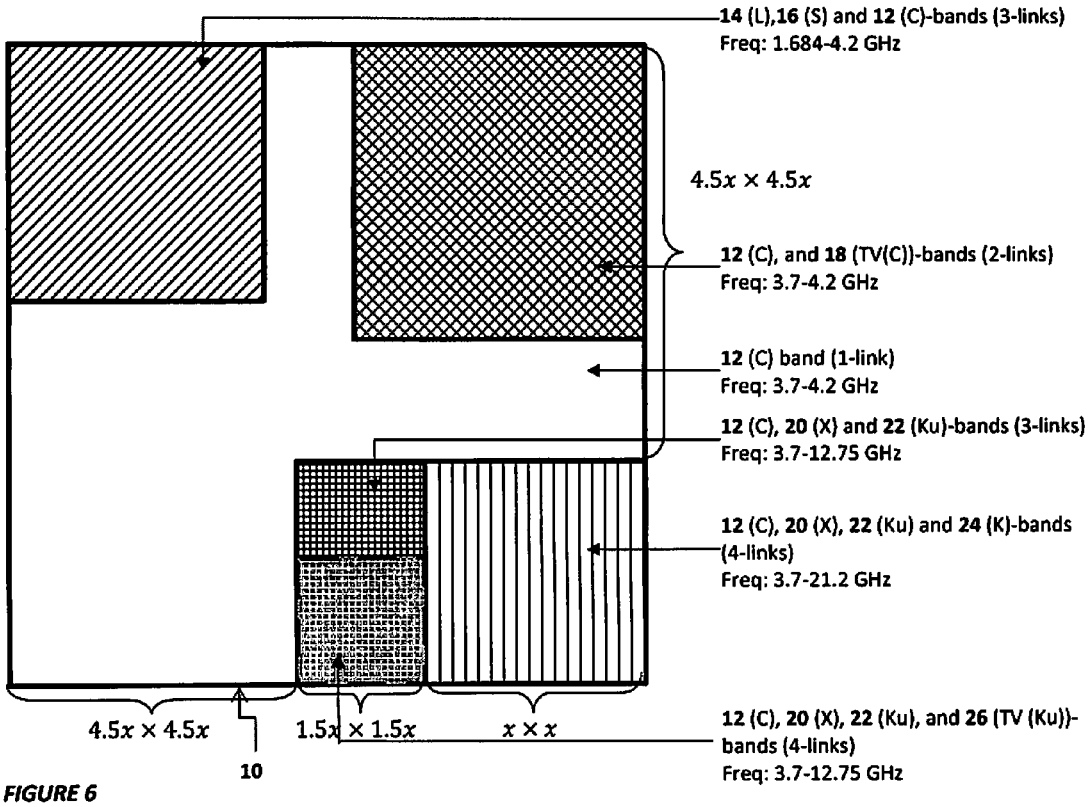
FIG. 6 shows an architecture of a Multi-Function Aperture for a Carrier (Architecture 4) according to the invention using arrays that have inter-element spacing of x, 1.5x and 4.5x, x=7.1 mm.

Table 2 shows the number of radiating elements needed by the C-, Ku-, and K-band arrays with the inter-element spacings used for the architectures shown in Architectures 2 and 4 (FIGS. 4 and 6). The other frequencies are not a concern since C-, Ku- and K-bands set the inter-element spacings. From the numbers in Table 2, it is observed that by increasing the inter-element spacing of the elements in the K-band to 7.1 mm from 5.9 mm, it is possible to reduce the number of elements in K-band array from 83,310 to 57,530. However, a smaller ratio for the middle and outer sections (i.e. 1.5x and 4.5x compared to 2x and 6x) means that now the inter-element spacings of elements at Ku- and C-band are smaller, hence these arrays will need more elements to satisfy the directivity requirements of these links. The number of elements increases from 16,280 to 20,000 for C-band and from 16,520 to 20,280 for Ku-band. In summary, finding the proper ratio of the inter-element spacings between the arrays is an optimization process and is chosen such that the total number of elements in the multi-function aperture is the smallest while at the same time the discontinuities between the array interfaces are not numerous. In this example, using the smaller set of ratios actually reduced the number of elements by almost 16%.

TABLE 2

NUMBER OF ELEMENTS FOR DIFFERENT ARRAYS BASED ON CHOSEN INTER-ELEMENT SPACINGS

| Array | Architecture 2 (x = 5.9 mm) | Architecture 4 (x = 7.1 mm) |
|---|---|---|
| C-band | 16,280 | 20,000 |
| Ku-band | 16,520 | 20,280 |
| K-band | 83,310 | 57,530 |
| Total Elements | 116,110 | 97,810 |

Figure 7:
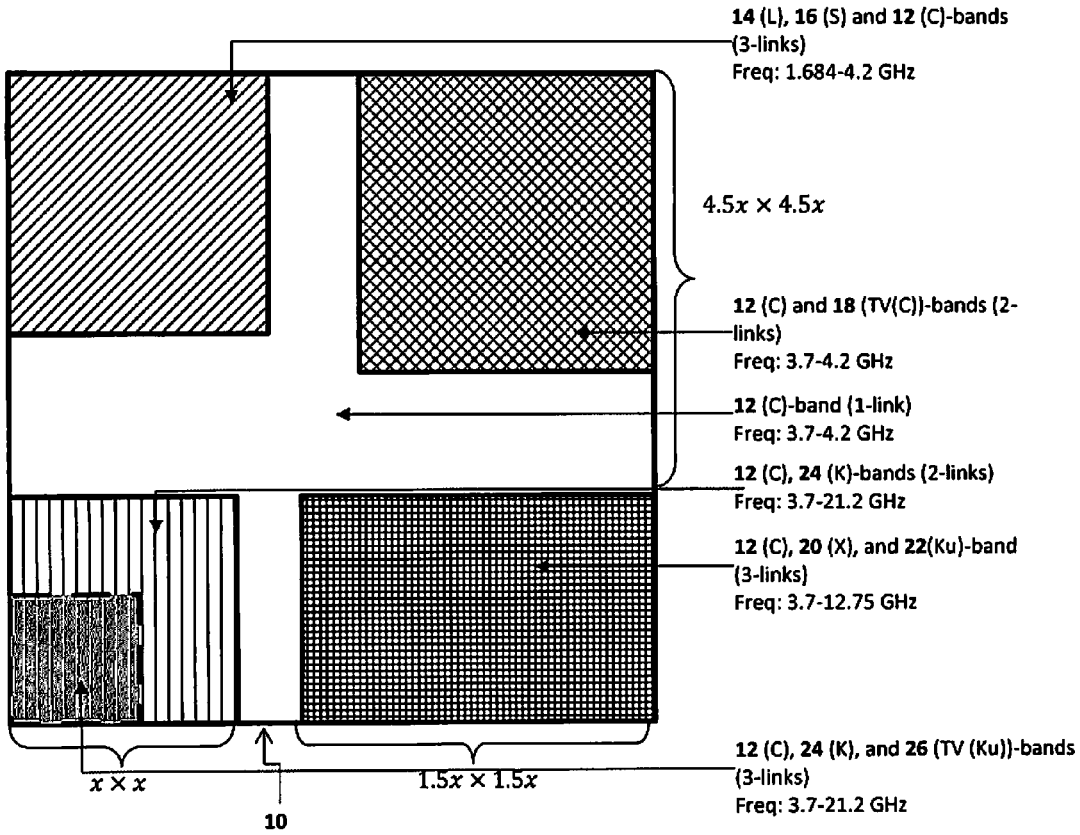
FIG. 7 shows an architecture of a Multi-Function Aperture for a Carrier (Architecture 5) according to the invention using arrays that have inter-element spacing of x, 1.5x and 4.5x, x=7.1 mm.

Finally, FIG. 7 (Carrier Architecture 5) shows a similar architecture as FIG. 5, except that now x=7.1 mm and the ratios are x, 1.5x and 4.5x. In this architecture, the total number of elements is 120,530, which is a 23% increase over the number of elements in Carrier Architecture 4 (shown in FIG. 6) and a 3.8% increase over the number of elements needed in Carrier Architecture 2 (shown in FIG. 4). The largest number of links required by any section of the multi-function array is three in Carrier Architecture 5. Therefore, this architecture should be considered when the reduction in the number of links is more important than reduction in the number of elements.

It is noted that Kindt et al. 1-2 considered ratios of inter-element spacings to be multiples of two to minimize the number of discontinuities. However, their numerical simulations indicated that the effect of the discontinuities is insignificant. Those simulations support the view that the effect of the discontinuities will be insignificant even for non-integer ratios that are used in Carrier architecture 4.

In summary, FIG. 6 (Carrier Architecture 4) represents an optimum architecture of a multi-function array for a carrier. Here, frequency scaled radiating elements have been employed with ratio of 1.5 and its multiples to reduce the number of elements significantly. The individual array apertures are dispersed over the Multi-Function aperture to reduce the number of links from any section of the Multi-Function aperture as well as to reduce the bandwidth requirement for the radiating elements. In addition, rectangular, instead of square, apertures are used, where it is possible and where it reduces the number of links and the bandwidth requirements of the radiating elements.

Combatant Architectures

The combatant is another class of Navy ship that also requires wideband multi-function arrays. The SATCOM downlinks specifications for combatants are similar but not exactly the same as those for carriers. Table 3 lists the specifications.

TABLE 3

SPECIFICATIONS OF SATCOM DOWNLINKS FOR A COMBATANT

| System | Downlink Frequency (GHz) | Notional Directivity (dB) | Notional Aperture Size ($m^2$) | Maximum Inter-Element Spacing $d_x \times d_y$ (mm) |
|---|---|---|---|---|
| Commercial TV-Links at C and Ku bands | 10.7-12.75 (Ku) | 49.0 | 5.2 | 11.8 × 11.8 |
| | 4.08-4.127 (C) | 41.0 | 5.3 | 36.3 × 36.3 |
| | 12.224 (Ku) | 43.0 | 1.0 | 12.3 × 12.3 |
| Navy | 20.2-21.2 (K) | 52.0 | 2.9 | 7.1 × 7.1 |
| | 7.25-7.75 (X) | 46.0 | 5.2 | 19.4 × 19.4 |

The biggest difference between combatant and carrier is the fact that the following links are not needed for a combatant: (1) Commercial C-band, MetOc (2) L-band and, (3) S-band. The lowest frequency for the combatant is 4.08 GHz (for TV(C)-band) and the highest is 21.2 GHz (K-band). This means that the largest bandwidth required from any section of the Multi-Function array is 5.2:1. The maximum number of links is five. If all the elements were spaced at λ/2 at the highest frequency over the entire aperture of 5.3 $m^2$, then a total of $$\left(\frac{5.3\ \text{m}^2}{\left(0.5\times\frac{3\times10^8\ \text{m/s}}{21.2\ \text{GHz}}\right)^2}\right)\cong 106{,}000$$

radiating elements will be needed, each requiring a bandwidth of 5.2:1.

Figure 8:
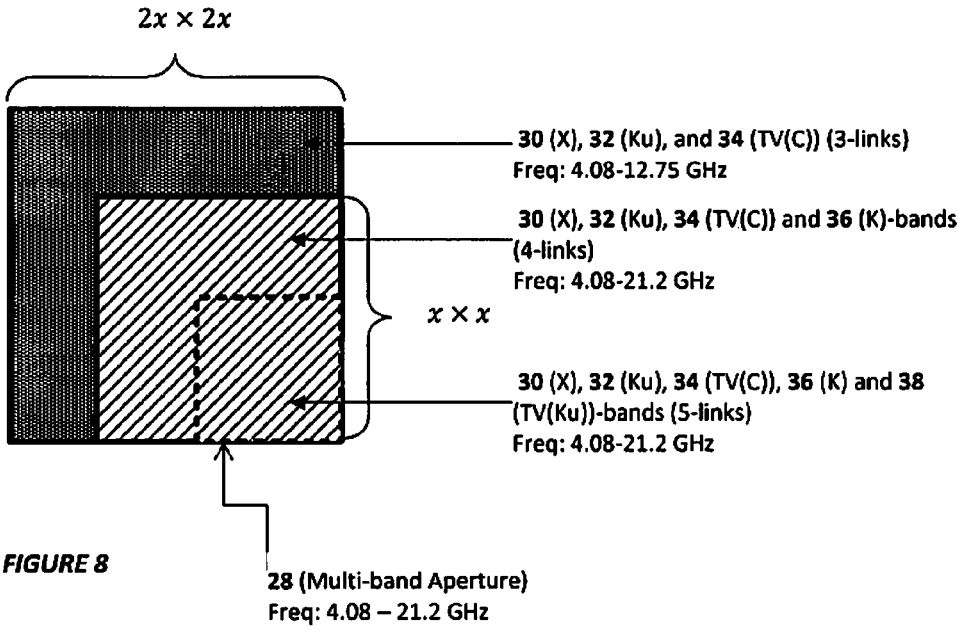
FIG. 8 shows an architecture of a prior art Multi-Function Aperture for a Combatant using frequency scaling.

As before, it is possible to reduce the number of elements by using the concept of frequency scaling. FIG. 8 shows the layout. The core of this architecture will have elements with inter-element spacing of x where from Table 3

$$x=\frac{11.8\ \text{mm}}{2}=5.9\ \text{mm}.$$

The value of 5.9 mm is chosen over 7.1 mm because we want to keep whole number multiples between the inter-element spacings of the different sections as discussed before for the case of the carrier. If the core has an inter-element spacing of 7.1 mm, then with a multiple of two, the inter-element spacing of the outer section will be 14.2 mm. This inter-element spacing will ensure no grating lobe formation for C- and X-bands. However, at Ku-band, this inter-element spacing is larger than the needed 11.8 mm and hence will result in grating lobe formation. To avoid this, 11.8 mm is selected as the basis inter-element spacing. It means that the inter-element spacing of the core will need to be 5.9 mm. However, using a smaller inter-element spacing in the core than maximum allowed (7.1 mm) means that more elements will be needed to satisfy the directivity requirements. The bandwidth ratio requirement for the elements in the core is $$\left(\frac{21.2\ \text{GHz}}{4.08\ \text{GHz}}\right)=5.2,$$

while the bandwidth ratio requirement in the outer section is $$\left(\frac{12.75}{4.08}\right)=3.125.$$

By using the frequency scaled approach (inter-element spacing of 5.9 mm in the core and inter-element spacing of 11.8 mm in the outer section), the total number of elements will be reduced from 106,000 to 100,600, which is only about a 5% savings in the number of elements.

Figure 9:
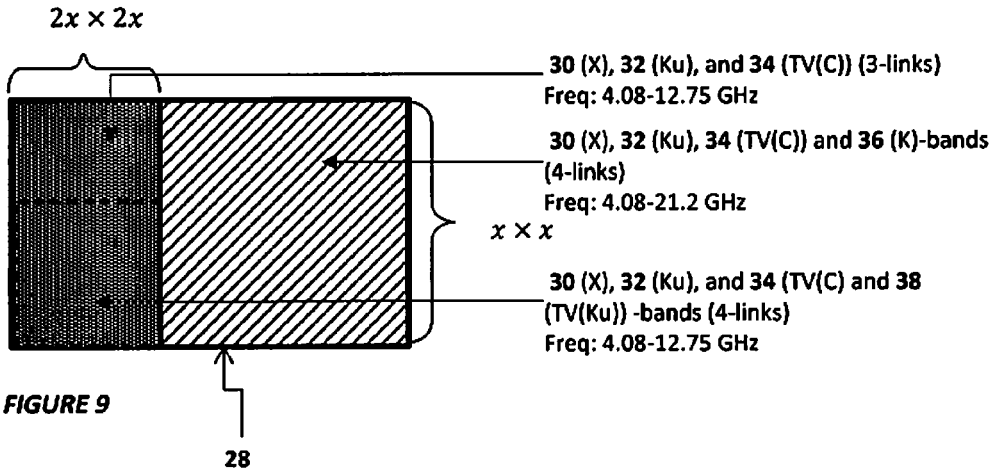
FIG. 9 shows an architecture of a Multi-Function Aperture (Architecture 1) for a Combatant according to the invention using square and rectangular arrays, x=5.9 mm.

Once again, the maximum number of links needed is five which is still a large number to realize with current technology. Since SATCOM applications, for which this multi-function aperture was designed, do not require equal beamwidths in both directions, rectangular arrays can be used. By not requiring all arrays to be square, the number of links can be reduced to four as shown in FIG. 9 (Combatant Architecture 1) without any increase in the number of elements. The number of elements in the architectures shown in FIGS. 8 and 9 is the same (100,600).

Figure 10:
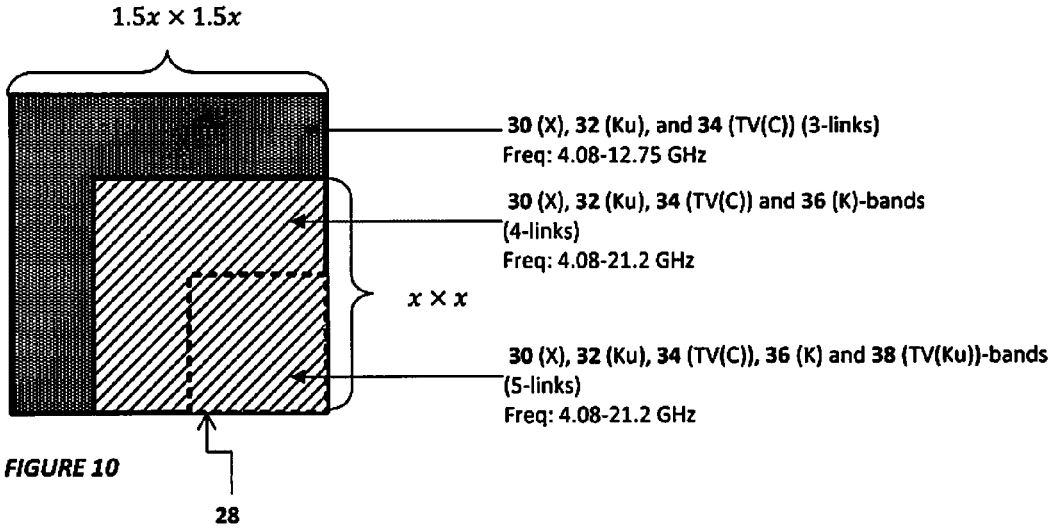
FIG. 10 shows an architecture of a Multi-Function Aperture (Architecture 2) for a Combatant according to the invention using square arrays with inter-element spacings of x and 1.5x, x=7.1 mm.

So far, combatant architectures where the ratio between the inter-element spacing of the different arrays is a whole number have been considered. In the following architectures, this constraint is removed. This allows the use of larger inter-element spacing of 7.1 mm at K-band and hence reduces the number of elements needed in the core to satisfy the directivity requirement. Now, the inter-element spacing for the outer array can be 1.5 times 7.1 mm (i.e. 10.65 mm) without generating grating lobes at the highest frequency of 12.75 GHz. With these new inter-element spacings, the number of elements needed to satisfy the directivity requirements is only 77,820, which result in 26.5% fewer elements compared to the case where equal sized elements are used over the entire Multi-Function aperture and 22% fewer elements when compared to the architecture shown in FIG. 8. FIG. 10 (Combatant Architecture 2) shows the architecture with the new inter-element spacing.

Figure 11:
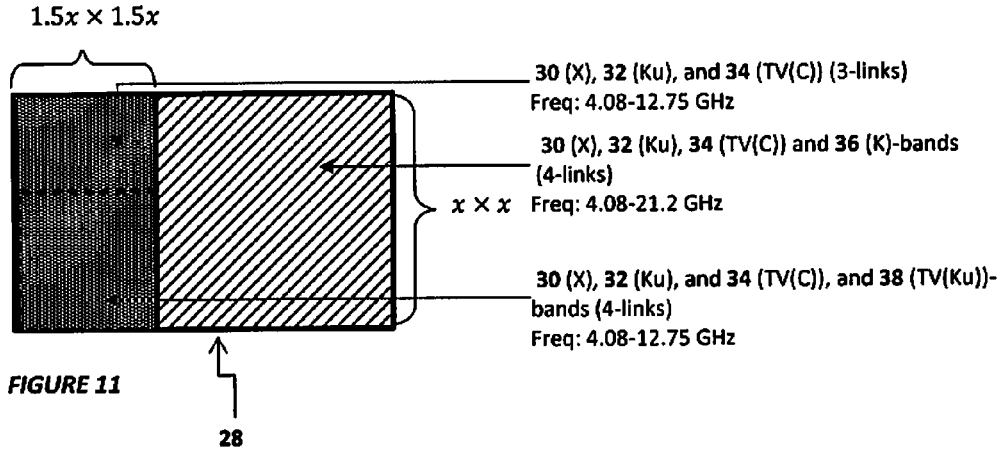
FIG. 11 shows an architecture of a Multi-Function Aperture (Architecture 3) for a Combatant according to the invention using square and rectangular arrays with inter-element spacings of x and 1.5x, x=7.1 mm.

As before, the number of links needed from any section of the Multi-Function aperture can be reduced by creating rectangular arrays and hence moving the TV(Ku)-band aperture out of the K-band array. This is shown in FIG. 11 (Combatant Architecture 3). This can be easily done because the inter-element spacing needed by TV (Ku) band should be less than 12.3 mm, and so 10.65 mm can be used. Combatant architecture 3 reduces the number of links by one without increasing the total number of elements or element bandwidth requirements when compared to Combatant Architecture 2.

So in summary, FIG. 11 (Combatant Architecture 3) represents an optimum architecture of a multi-function aperture for a combatant. Here, we used frequency scaled radiating elements with ratio of 1.5 and its multiples to reduce the number of elements. The individual apertures are dispersed over the larger Multi-Function aperture to reduce the number of links from any given part of the Multi-Function aperture as well as to reduce the bandwidth requirement for the radiating elements. In addition, rectangular, instead of square, apertures are used for individual arrays, where it is possible and where it reduces the number of links and bandwidth requirements.

The embodiments of the invention discussed above are useful for SATCOM systems on Navy Carrier and Combatant ships. In addition, the invention can be used for other applications/architectures for affordable wideband multi-function phased arrays. While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

What is claimed as new and desired to be protected by Letters Patent of the United States is:

1. A wideband multi-function phased array antenna comprising a plurality of apertures comprising:

a first aperture having a largest area of the plurality of apertures and having a first frequency band;

a second aperture, comprising a first plurality of frequency scaled radiating elements and having a second frequency band, dispersed over a first corner of the first aperture;

a third aperture, comprising a second plurality of frequency scaled radiating elements and having a third frequency band, dispersed over a second corner of the first aperture, wherein the second corner does not overlap with the first corner;

a fourth aperture, comprising a third plurality of frequency scaled radiating elements and having a fourth frequency band, dispersed over the first aperture; and wherein the second aperture, the third aperture, and the fourth aperture of the phased array antenna are configured to function independently of each other.

2. The wideband multi-function phased array antenna of claim 1, wherein each aperture of the plurality of apertures has a square geometry.

3. The wideband multi-function phased array antenna aperture of claim 1, wherein each aperture of the plurality of apertures has a rectangular geometry.

4. The wideband multi-function phased array antenna of claim 1, wherein the plurality of apertures comprise at least one aperture having a square geometry and at least one aperture having a non-square rectangular geometry.

5. The wideband multi-function phased array antenna of claim 1, wherein respective ratios of inter-element spacings between different apertures of the plurality of apertures are whole numbers.

6. The wideband multi-function phased array antenna of claim 1, wherein respective ratios of inter-element spacings between different apertures of the plurality of phased array antenna apertures are not whole numbers.

7. A wideband multi-function phased array antenna aperture, comprising:

a core array dispersed over a first corner of the wideband multi-function phased array antenna aperture;

a first plurality of phased array apertures, configured to operate using a first frequency band, dispersed over the wideband multi-function phased array antenna aperture, wherein the first plurality of phased array apertures form respective layers around the core array;

a second plurality of phased array apertures, configured to operate using a second frequency band, dispersed over a second corner of the wideband multi-function phased array antenna aperture; and a third plurality of phased array apertures, configured to operate using a third frequency band, dispersed over the wideband multi-function phased array antenna aperture, wherein each aperture of the first plurality of phased array apertures, the second plurality of phased array apertures, and the third plurality of phased array apertures comprise a plurality of frequency scaled radiating elements, and wherein the second plurality of phased array apertures and the third plurality of phased array apertures are asymmetrically dispersed with respect to a center of the wideband multi-function phased array antenna aperture.

8. The wideband multi-function phased array antenna aperture of claim 7, wherein the first plurality of phased array apertures are positioned at a lower right corner of the wideband multi-function phased array antenna aperture.

9. The wideband multi-function phased array antenna aperture of claim 8, wherein the second plurality of phased array apertures are positioned at an upper left former of the wideband multi-function phased array antenna aperture.

10. The wideband multi-function phased array antenna aperture of claim 8, wherein the third plurality of phased array apertures are positioned at an upper right former of the wideband multi-function phased array antenna aperture.

11. The wideband multi-function phased array antenna aperture of claim 7, wherein the first plurality of phased array apertures comprise X-band, Ku-band, K-band, and TV(Ku)-band array apertures.

12. The wideband multi-function phased array antenna aperture of claim 7, wherein the second plurality of phased array apertures comprise L-band, S-band, and TV(C)-band array apertures.

13. The wideband multi-function phased array antenna of claim 1, wherein the second aperture and the third aperture are dispersed over the first aperture such that a bandwidth of the frequency scaled radiating elements is reduced.

14. The wideband multi-function phased array antenna of claim 1, wherein the second plurality of frequency scaled radiating elements of the second aperture have a first bandwidth, and wherein the third plurality of frequency scaled radiating elements of the third aperture have a second bandwidth.

15. The wideband multi-function phased array antenna of claim 1, wherein the second aperture has a first beamwidth, wherein the third aperture has a second beamwidth, and wherein the second beamwidth is not symmetrical with respect to the first beamwidth.

16. A wideband multi-function phased array antenna comprising a plurality of apertures comprising:

a first aperture having a first frequency band and having a largest area of the plurality of apertures;

a second aperture, comprising a first-plurality of frequency scaled radiating elements and having a second frequency band, wherein the second aperture is dispersed over a first corner of the first aperture;

a third aperture, comprising a second plurality of frequency scaled radiating elements and having a third frequency band, wherein the third aperture is dispersed over a second corner of the first aperture, wherein the second aperture is not positioned around the third aperture, and wherein the third aperture is not positioned around the second aperture;

the second aperture and the third aperture of the phased array antenna are configured to function independently of each other, wherein a height-to-width ratio of the third aperture is different than a height-to-width ratio of the second aperture; and a fourth aperture, comprising a third plurality of frequency scaled radiating elements and having a fourth frequency band, dispersed over the first aperture.

17. The wideband multi-function phased array antenna of claim 16, wherein the fourth aperture is positioned around the third aperture.

18. The wideband multi-function phased array antenna of claim 17, further comprising:

a fifth aperture, comprising a fourth plurality of frequency scaled radiating elements and having a fifth frequency band, wherein the fifth aperture is dispersed over a third corner of the first aperture.

19. The wideband multi-function phased array antenna of claim 18, further comprising:

a sixth aperture, comprising a fifth plurality of frequency scaled radiating elements and having a sixth frequency band, wherein the sixth aperture is dispersed over a fourth corner of the first aperture.

20. The wideband multi-function phased array antenna of claim 17, further comprising:

a fifth aperture, comprising a fourth plurality of frequency scaled radiating elements and having a fifth frequency band, wherein the fifth aperture is positioned around the second aperture.

* * * * *